United States Patent [19]

Stelzer et al.

[11] Patent Number: 4,535,648

[45] Date of Patent: Aug. 20, 1985

[54] CONTROL HANDLE EXTENSION

[76] Inventors: Jack C. Stelzer, 11786 Duchess, Detroit, Mich. 48224; Joseph E. Fritsch, 14001 Sherwood, Oak Park, Mich. 48237

[21] Appl. No.: 510,546

[22] Filed: Jul. 5, 1983

[51] Int. Cl.[3] ..... G05G 1/00

[52] U.S. Cl. ..... 74/544; 403/157; 403/348; 403/287; 403/209

[58] Field of Search ..... 74/562, 562.5, 546, 74/544; 403/348, 359, 209, 213, 157, 158, 159, 287

[56] References Cited

U.S. PATENT DOCUMENTS

| | | | |
|---|---|---|---|
| 99,508 | 2/1870 | Williams | 403/359 |
| 1,256,244 | 2/1918 | Mellin . | |
| 1,262,425 | 4/1918 | Young . | |
| 1,278,100 | 9/1918 | Bruning . | |
| 2,036,948 | 4/1936 | McNary . | |
| 2,853,897 | 9/1958 | Loewy . | |
| 3,103,130 | 9/1963 | Gunter | 74/562 |
| 3,175,420 | 3/1965 | Craig | 74/544 |
| 3,456,525 | 7/1969 | Oldham . | |
| 3,507,259 | 4/1970 | Lankford | 74/544 |
| 3,722,319 | 3/1973 | Reznik et al. . | |
| 3,962,748 | 6/1976 | Michaels . | |
| 4,197,764 | 4/1980 | Auernhammer . | |

FOREIGN PATENT DOCUMENTS

| | | | |
|---|---|---|---|
| 158263 | 1/1953 | Australia | 403/209 |

*Primary Examiner*—Kenneth J. Dorner

[57] ABSTRACT

A handle extension provides a means by which a control on a power-operated device, such as a snow thrower, can be manipulated from a more convenient and safer location. A rod-like control extension handle is coupled to an existing control handle or lever by a unique connecting bracket which is so configured that when the present invention is installed by an unskilled person, the said connecting bracket in combination with the said rod-like control extension handle prevents binding of the present invention with the existing control handle thereby permitting more precise control of the power-operated device.

10 Claims, 4 Drawing Figures

CONTROL HANDLE EXTENSION

TECHNICAL FIELD

The present invention relates generally to extension handles, and more particularly to extension handles used to manipulate various controls on power operated devices.

BACKGROUND OF THE INVENTION

Various power operated devices such as: grass cutters, floor sanders, snow throwers, carpet cleaners, roto tillers and many other pieces of power-driven equipment requires the operator to make various and sometimes numerous adjustments to adjust the speed, direction, force or various other functions during the operation of these power-driven devices which necessitates frequent bending and/or reaching which is not only physically fatiguing but could place the operator's hands, feet or eyes in a hazardous position.

Extension handles for operating controls from a distance are well known. Examples are illustrated in U.S. Pat. No. 2,853,897, issued Sept. 30, 1958 and U.S. Pat. No. 3,962,748, issued June 15, 1976. It would appear that the designs of the foregoing patents while generally satisfactory for certain applications, would not find widespread use due to the relatively high cost of manufacturing the components such as the telescoping elements. In addition, no provision is made for misalignment of the extension handle to the control. While some of the disadvantages set forth above would appear to be overcome in U.S. Pat. No. 2,036,948, issued Apr. 7, 1936 and U.S. Pat. No. 3,456,525, issued July 22, 1969, it should be observed that these designs are of assemblies that incorporate many costly components.

DISCLOSURE OF INVENTION

It is the object of the present invention to provide an extension handle with an improved method of fastening said invention to an existing control handle used on a power-operated device.

It is another object of the present invention to provide an extension handle that can be produced at relatively low cost yet provide a solid and stable connection with respect to rotational and longitudinal forces.

It is another object of the present invention to provide an extension handle that can be installed by an unskilled person by providing a means to automatically correct for misalignment of the extension handle to the control of a power-operated device.

DETAILED DESCRIPTION

Figure 1:
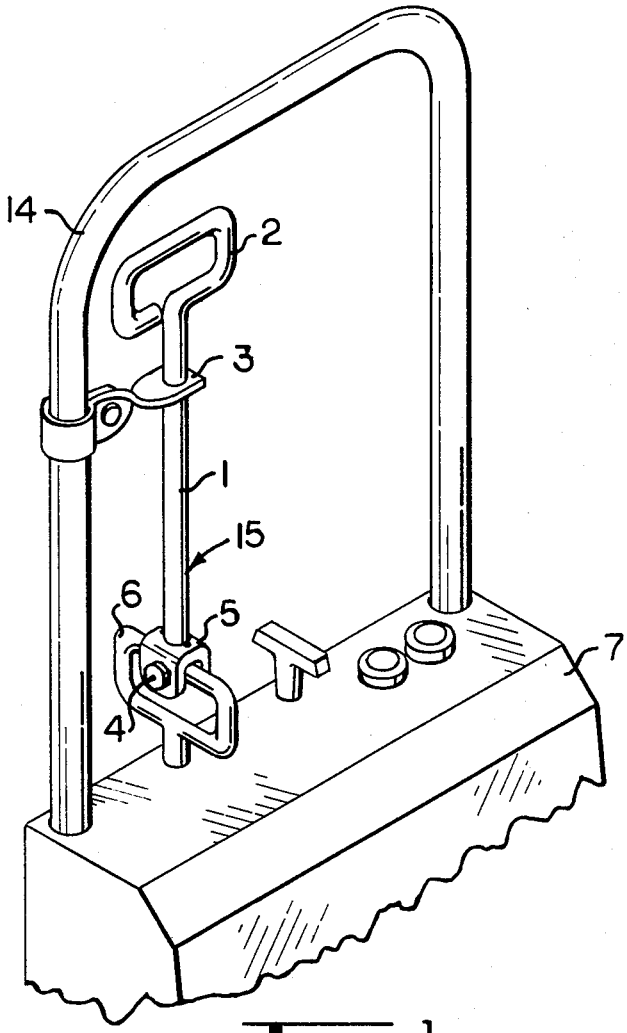
FIG. 1 is a perspective view illustrating the present invention installed on a power-operated device.

Referring to FIG. 1 an extension handle, generally indicated at 15 is shown installed on a conventional power-operated device, generally indicated at 7. The extension handle comprising a rod 1 having a handle 2 at one end for easy manipulation thereof. The rod 1 may be of any suitable length, the second end of which is engaged with a control handle 6 of the power-operated device 7 by means of a connecting bracket 5. Stability of the upper portion of the extension handle 15 is provided by an upper support bracket 3 which is shown attached to handle 14 of the power-operated device. It must be appreciated that this upper support bracket 3 could be attached to any part of the power-operated device which would place the handle 2 of the present invention in a convenient location for the operator.

Figure 2:
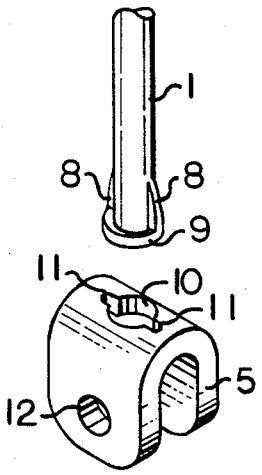
FIG. 2 is an enlarged perspective view of the connecting portion of the present invention illustrating the preferred embodiment.

Referring now to FIG. 2 the connecting bracket 5 may be of any suitable construction. The preferred embodiment shown here comprising an enlarged shoulder 9 formed on the second end of rod 1 with two vertical wing-like flanges 8. Rod 1 extends through hole 10. The flanges 8 prevent rotational movement between the rod 1 and the connecting bracket 5. The enlarged shoulder 9 prevents disengagement of the second end portion of rod 1 from hole 10. The hole 10 and slots 11 are sized to provide enough clearance with rod 1 and flanges 8 to prevent binding with the connecting bracket 5 which is securely fastened to the control handle 6 of the power-operated device 7 with a bolt 4 through in-line holes 12 (only one hole shown).

The primary advantage of this construction is to allow the rod 1 to automatically adjust to a position that prevents binding of the extension handle 15 when said extension handle is installed by an inexperienced person.

Figure 4:
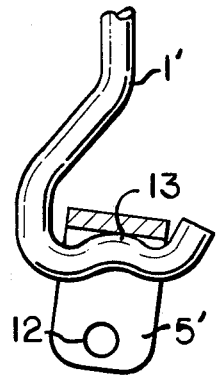
FIG. 4 is a cross sectional view taken on line 4—4 of FIG. 3.
Figure 3:
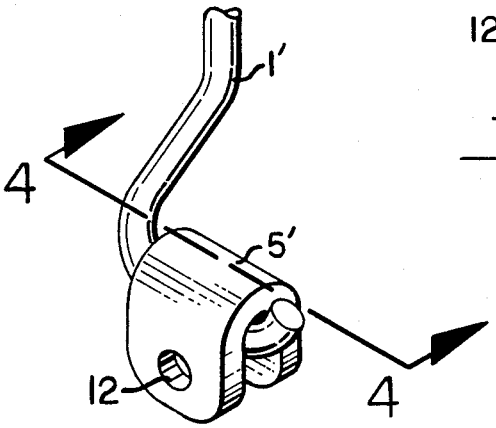
FIG. 3 is an enlarged perspective view of a different embodiment of the connecting portion of the present invention.

Referring now to FIG. 3 an alternate construction is shown. This alternate construction can be better understood by referring to FIG. 4 which is a cross section taken on line 4—4 of FIG. 3. The second end of rod 1' is formed in a truncated hook shape with a reverse bend 13 providing a pivot point and enough clearance to allow the connecting bracket 5' to adjust to any misalignment of the extension handle. The connecting bracket 5' is shown in a misaligned position.

Obviously many modifications are possible in light of the above teaching. It is, therefore, to be understood that within the scope of the appended claims the invention may be practiced otherwise than as specifically described.

What is claimed is:

1. A control handle extension comprising:

a rod-like member having a first end portion including a handle rotatable with said rod-like member and a second end portion including an enlarged shoulder with a plurality of flanges extending axially to said enlarged shoulder;

a u-shaped connecting bracket slidably disposed on the second end portion of said rod-like member;

said connecting bracket having an opening through its center section whose contour, including enough radial clearance to facilitate axial and tilting movement, is similar to a cross section of said rod-like member taken through said flanges;

whereby said flanges prevent rotary movement between said rod-like member and said connecting bracket;

said connecting bracket including spaced apart parallel side portions extending on either side of a control handle used on a power-operated device;

fastening means to rigidly attach said parallel side portions to said control handle.

2. The control handle extension defined in claim 1 wherein the said fastening means to rigidly attach said parallel side portions to said control handle is with one or more bolts.

3. The control handle extension defined in claim 1 wherein an upper support bracket is attached to the said power-operated device;

said upper support bracket having means to rotatably support said rod-like member.

4. The control handle extension defined in claim 1 wherein the said handle is formed from the said first end portion of the said rod-like member.

5. The control handle extension defined in claim 1 wherein the said power-operated device is a snow thrower.

6. A control handle extension comprising:

a rod-like member having a first end portion including a handle rotatable with said rod-like member and a second end portion formed into a truncated hook-shaped engaging means;

said hook-shaped engaging means having a reverse bend formed at center of said hook shape;

a u-shaped connecting bracket disposed on said engaging means;

said connecting bracket including spaced apart parallel side portions extending on either side of said engaging means and extending still further on either side of a control handle used on power-operated device;

fastening means to rigidly attach said parallel side portions to said control handle.

7. The control handle extension defined in claim 6 wherein the said fastening means to rigidly attach said parallel side portions to said control handle is with one or more bolts.

8. The control handle extension defined in claim 6 wherein an upper support bracket is attached to the said power-operated device;

said upper support bracket having means to rotatably support said rod-like member.

9. The control handle extension defined in claim 6 wherein the said handle is formed from the said first end portion of the said rod-like member.

10. The control handle extension defined in claim 6 wherein the said power-operated device is a snow thrower.

* * * * *